US006115942A

United States Patent [19]

Paradis

[11] Patent Number: 6,115,942

[45] Date of Patent: Sep. 12, 2000

[54] FOOTWEAR PROVIDED WITH A RESILIENT SHOCK ABSORBING DEVICE

[75] Inventor: Frédéric Alexandre Paradis, Annecy, France

[73] Assignee: Frederic Paradis, Annecy, France

[21] Appl. No.: 09/180,782

[22] PCT Filed: Nov. 20, 1997

[86] PCT No.: PCT/FR97/00850

§ 371 Date: Nov. 13, 1998

§ 102(e) Date: Nov. 13, 1998

[87] PCT Pub. No.: WO97/42845

PCT Pub. Date: Nov. 20, 1997

[30] Foreign Application Priority Data

May 13, 1996 [FR] France ..... 96 06386

[51] Int. Cl.[7] ..... A43B 13/28; A43B 21/30; A43B 7/16

[52] U.S. Cl. ..... 36/27; 36/38; 36/92

[58] Field of Search ..... 36/89, 27, 38, 36/92, 28

[56] References Cited

U.S. PATENT DOCUMENTS

| | | | |
|---|---|---|---|
| 1,942,312 | 1/1934 | Tutoky | 36/38 |
| 5,056,509 | 10/1991 | Swearington | 36/89 X |
| 5,060,401 | 10/1991 | Whatley | 36/27 X |
| 5,279,051 | 1/1994 | Whatley | 36/27 X |
| 5,282,325 | 2/1994 | Beyl | 36/27 |
| 5,337,492 | 8/1994 | Anderié et al. | 36/27 X |
| 5,672,156 | 9/1997 | Jimenez Ramos | 36/89 X |

*Primary Examiner*—Paul T. Sewell
*Assistant Examiner*—Anthony Stashick

[57] ABSTRACT

The shoe construction of the present invention includes an upper and a sole comprised of a lower portion which is mobile with respect to the upper portion, and at least one leaf spring which resiliently resists forces tending to bring closer together the lower and upper portions of the sole. The leaf spring or springs are arranged outside the space taken by the user's foot, and advantageously bend in a manner similar to buckling.

16 Claims, 7 Drawing Sheets

FIG.12
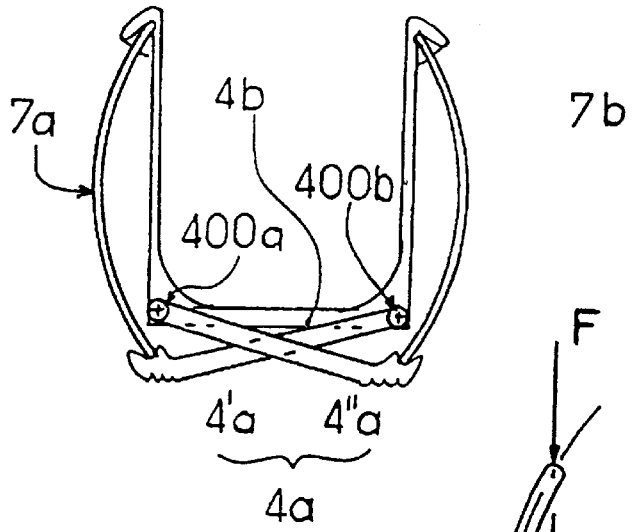
FIG.13a
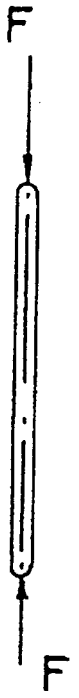
FIG.13c
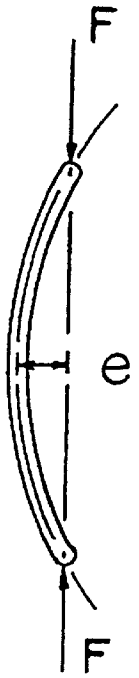
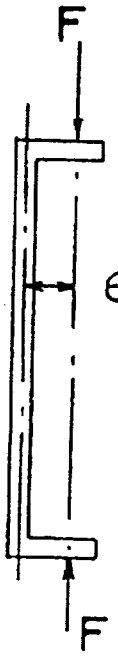
FIG.13b
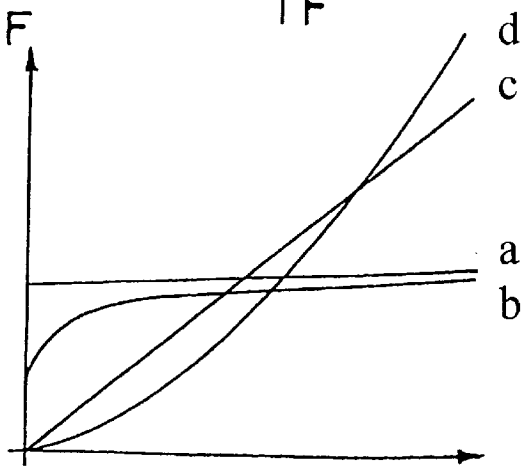
FIG.14

FOOTWEAR PROVIDED WITH A RESILIENT SHOCK ABSORBING DEVICE

BACKGROUND OF THE INVENTION

This invention relates to footwear, and more particularly to a heel construction which absorbs peak shock forces encountered when running.

When walking or running, generally the first contact with the ground is made with the heel, followed by weight transfer to the fore part of the foot, before finally pushing off the ball of the foot, propulsing the body forward and upward. The heel contact on the ground results in a peak force equal to two or three times the runner's weight, depending mainly on the speed. While this peak is of short duration, the high number of cycles can provoke fatigue injuries, or worsen existing injuries or weaknesses (ankles, knees, back etc).

A wide variety of shock absorbing heel constructions are known, for example, those using enclosed air or a layer of foam in the midsole, but these are not efficient, and for a given energy and compression distance, the maximum force at full compression is high, the force-displacement curve is not linear and the energy absorbed, equal to the area under the aid curve, is less than that obtained using a linear spring. To store an equal amount of energy while reducing or maintaining the maximum force, the compression distance must be increased, and the foam or air sole stiffness must be decreased, thus creating foot stability problems.

Some patents, (for example CH 228,630 or U.S. Pat. No. 3,886,674) describe a shoe having a sole in two stiff portions, pivoting about an axis near the ball of the foot, with several helical springs between the two stiff portions under the heel. This design gives good lateral stiffness, but the heel is quite high (compression is limited by the solid height of the spring) and therefore unstable, and heavy (metal springs).

Patent FR 2,686,233 disclosed a similar hinge-type mechanism, but with a helical torsion spring. The spring ends are initially nearly vertical, forming an obtuse angle which opens during the heel compression, increasing the angle and corresponding moment arm and thus reducing the increase in vertical force. This construction gives a relatively high spring reaction force after a small compression, and a lower maximum force than a linear spring. The drawbacks remain the weight (high with respect to the energy stored) and the heel height (equal to the compression distance plus the spring diameter plus the plates and soles thicknesses). Also, the spring ends rubbing on the plates is a source of wear and friction which reduces the energy return.

Previous designs, such as those referred to above, exhibit various disadvantages as mentioned above, namely, a spring force-displacement curve giving high forces at full compression, with little gain over the current foam and air soles, but with higher weight, costs, and heel height, and corresponding instability.

Accordingly, it is an object of the present invention to provide a shoe construction, and in particular a heel construction for a shoe, that minimizes the heel impact force during heel strike, with a minimum heel height and corresponding high stability, and a high energy storage and return capacity. Another object of the invention is to provide a light weight shoe construction wherein the stiffness of the shock absorbing device can be set by simple means, and at a reasonable cost.

SUMMARY OF THE INVENTION

The shoe construction of the present invention includes an upper and a sole comprised of a lower portion which is mobile with respect to the upper portion, and at least one leaf spring which resiliently resists forces tending to bring closer together the lower and upper portions of the sole. The leaf spring or springs are arranged outside the space taken by the user's foot, and advantageously bend in a manner similar to buckling.

In a preferred form, the leaf spring or springs are manufactured in composite materials, with high strength unidirectional fibres at least on the external faces, particularly fiberglass, and/or polyethylene, and/or polyester, and/or carbon, and/or aramid fibers, with a thermosetting or thermoplastic matrix.

In another aspect of the invention, the lower portion of the sole pivots about a transverse (or longitudinal) axis with respect to the upper portion.

In a preferred form, the shoe comprises two lateral leaf springs, the lower end of each spring is vertically aligned with the user'ankle, while the relatively long springs comprise a force component which resiliently resists forces tending to bring closer together the lower and upper portions of the sole.

In another aspect of the invention, the leaf springs are tilted at an adjustable angle, for example by adjusting the length of least one of the links connecting the upper end of each spring to the upper portion of the sole.

The moment of inertia of the middle of the leaf springs should be at least equal to the moment of inertia of the upper and lower ends, and the core of the springs can be made of a relatively soft matter such as an elastomer, or of stiffer plastic, the density of the spring ends being at least equal to the density at the middle. The core can also be made of composite material, comprising fibers with a transverse component.

In a preferred form, the shoe comprises two lateral leaf springs, the lower end of each spring is connected to the lower portion of the sole, vertically aligned with the user's ankle, and the upper end of each spring is connected to the upper portion of the sole. These connections can be made, for example, by placing the lower ends of the springs in housings on the lower portion of the sole, or with a supple retaining link fixed at one end to the lower portion of the sole, wrapped around a small vertical flange, and fixed at the other end to the lower end of the leaf spring.

These and other features and advantages of the invention will become apparent from the following detailed description of preferred embodiments when taken in conjunction with the accompanying drawings, shown as examples.

BRIEF DESCRIPTION OF THE DRAWINGS

FIG. 1 is a side view.

FIGS. 2 and 3 are rear views in vertical section taken alone line AA in FIG. 1, showing the shoe in the two extreme positions.

FIG. 2 illustrates the shoe at rest.

FIG. 3 illustrates the shoe at maximum compression.

FIG. 12 is a rear view of an alternative embodiment incorporating two hinges with longitudinal axes.

FIGS. 13*a,* 13*b* and 13*c* illustrate three ways of applying the load on the leaf springs.

FIG. 14 is a graph corresponding to FIGS. 13*a,* 13*b* and 13*c* showing force deflection curves for these different conditions.

DETAILED DESCRIPTION OF THE PREFERRED EMBODIMENTS

Figure 1:
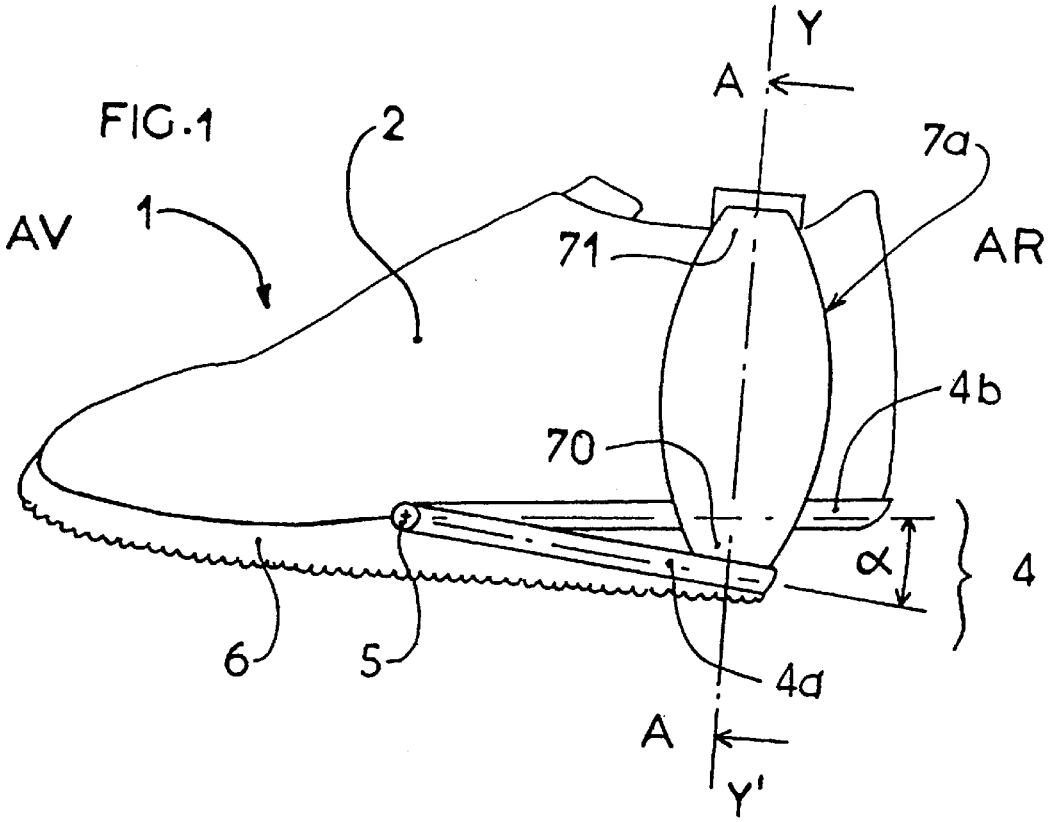
FIGS. 1, 2, and 3 illustrate an embodiment of the invention.

Referring to FIG. 1, the shoe 1 according to the invention comprises an upper 2 in which the user places his foot. According to one of the features of the invention, the sole 4 is composed of a mobile lower portion 4*a* or mobile lower sole which pivots about a transverse axis 5 on the upper portion 4*b* or upper sole. The lower portion 4*a* advantageously comprises an outer sole 6. When at rest, the lower portion 4*a* of the sole forms an acute angle α dihedron with the upper portion 4*b,* open towards the rear (AR). In this position, the angular space between the two portions 4*a* and 4*b* is maintained by the leaf springs 7*a* and 7*b,* which resist against the closing of the angle space between the said sole portions.

According to one of the features of the invention, the resilient shock absorbing means are composed of at least one elastic leaf spring 7*a,* 7*b,* advantageously bending in a manner substantially similar to buckling.

Figure 2:
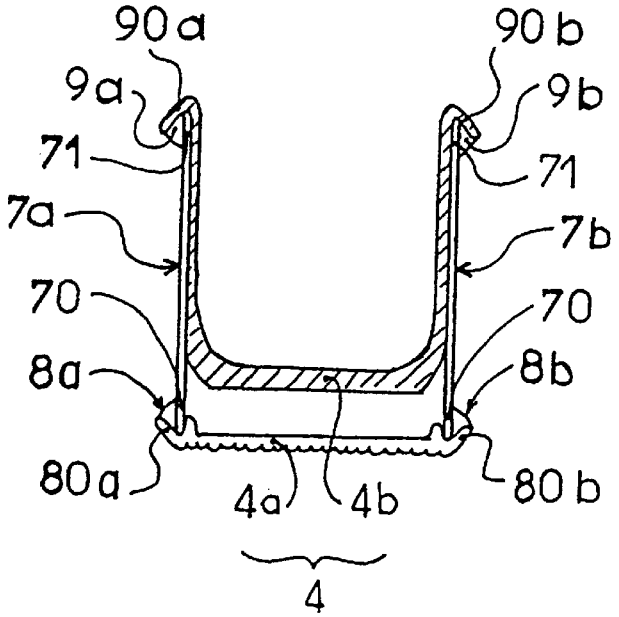
Figure 3:
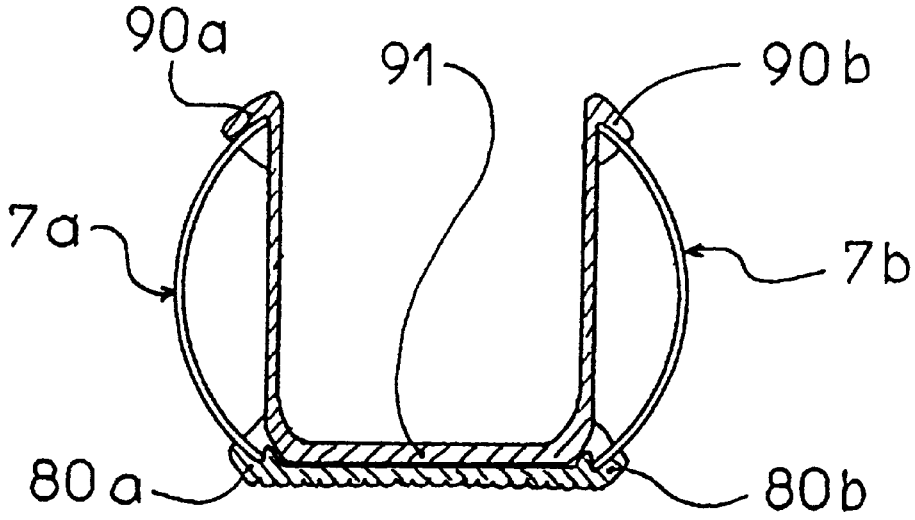

According to the first embodiment of the invention illustrated in FIGS. 1, 2, and 3, the shoe comprises two leaf springs 7*a* and 7*b,* one on each side of the shoe, generally vertically aligned with the user's ankle. Each leaf spring 7*a,* 7*b,* is relatively long and generally vertical.

Each spring 7*a,* 7*b* is connected at its upper end 71 and lower end 70 to the sole upper portion 4*b* and lower portion 4*a* respectively. The connecting means consist of a lower spring housing 8*a,* 8*b,* on the mobile lower sole portion 4*a,* vertically aligned with the upper spring housing 9*a,* 9*b,* on the upper sole portion 4*b,* so as to maintain the corresponding spring 7*a,* 7*b* generally vertical. Each lower housing 8*a,* 8*b,* consists of a V-shaped groove comprising a lower retaining edge 80*a,* 80*b* open laterally, allowing the outwards bending of the buckling leaf spring retained in the housing, as illustrated in FIG. 3. Likewise, each upper housing 9*a,* 9*b,* is composed of a V-shaped groove open downwards, comprising an upper retaining edge 90*a,* 90*b,* open laterally, allowing the outwards bending of the buckling leaf spring retained in the housing, as illustrated in FIG. 3. Advantageously, the two upper retaining housing 9*a* and 9*b* can be made part of the heel counter 91 which comprises a U open upwards to connect the two upper housings to the upper portion 4*b* of the sole.

It will be understood that means must be provided for to limit the pivoting of the lower potion 4*a* with respect to the upper portion 4*b* of the sole, and thus limit the maximum angle α between the said sole portions. Thus, when the user walks or runs, the force of the lower potion 4*a* of the sole on the ground is equal to the force due to the user's weight on the upper portion 4*a,* plus the kinetic energy of the moving mass. The compression forces in the leaf springs 7*a* and 7*b* increase very quickly, for a small compression distance, until the critical or Euler load is reached, at which point the leaf springs buckle. After buckling, a small increase in load gives rise to a high deflection, similar to a highly prestressed soft linear spring. According to this first embodiment of the invention, it is possible to adapt the spring 7*a,* 7*b* stiffness to the user's needs, based ion his weight and use (running, jogging, walking) by snapping the appropriate springs in the upper 9*a,* 9*b* and lower 8*a,* 8*b* housings.

Figure 4:
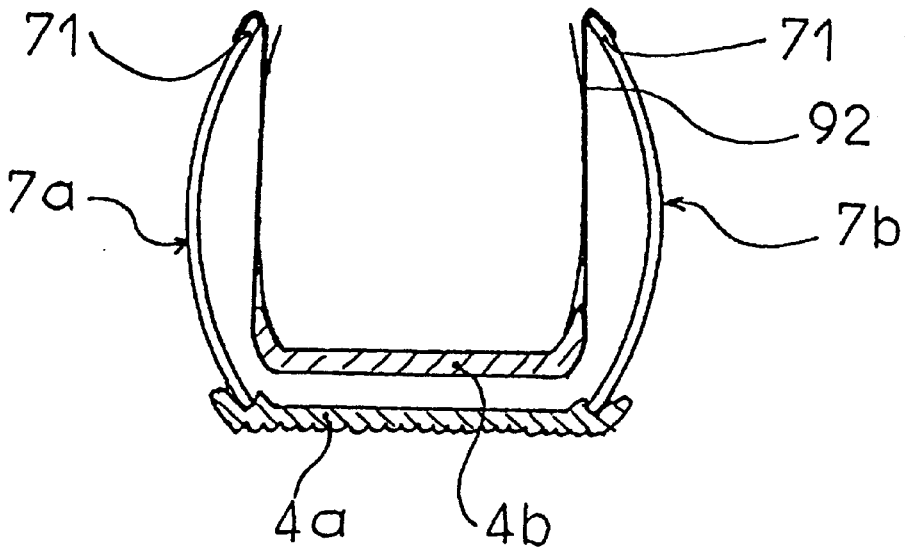
FIG. 4 is a rear view in vertical section of another embodiment, at mid-compression.

According to the alternative embodiment of the invention illustrated in FIG. 4, the upper connecting means are composed of a flexible line 92, for example, a cable or strap, in place of the upper housings 9*a* and 9*b* described above. Thus, the flexible link is fixed at one end to the leaf spring 7*a* upper end 71, wrapped under and fixed to the upper portion 4*b* of the sole, and fixed at its other end to the other leaf spring 7*b* upper end. Advantageously the length of the link 92 could be adjustable so as to vary the maximum compression distance, and/or the maximum opening of angle α.

Figure 5:
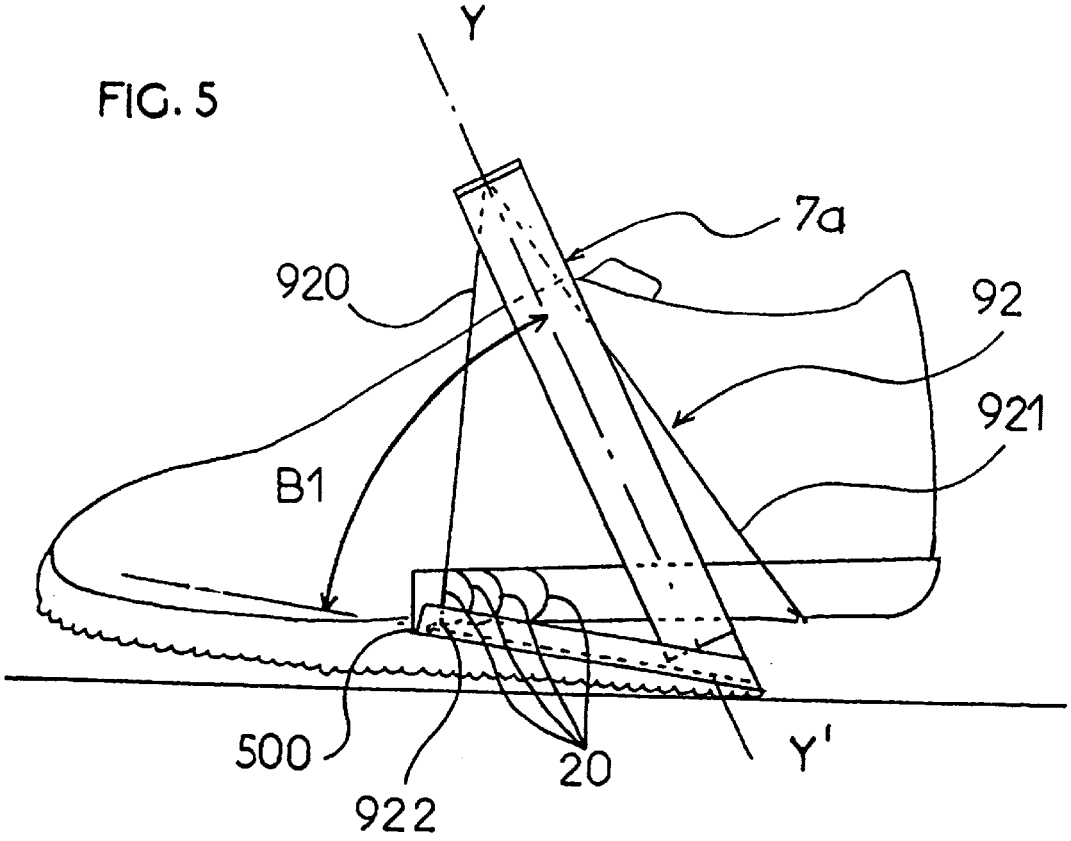
FIGS. 5 and 6 are side views of another embodiment.
Figure 6:
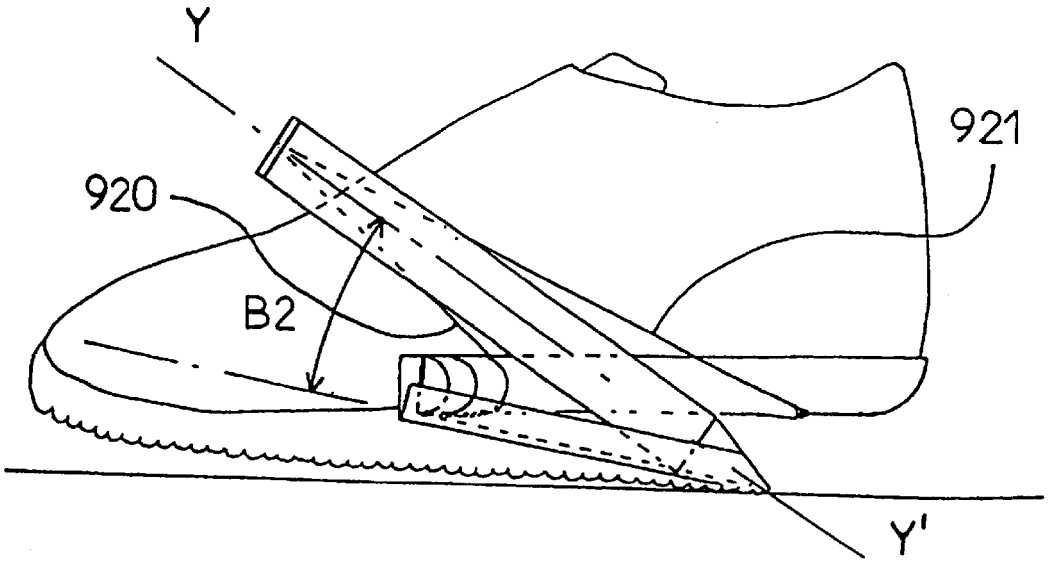

In the third embodiment of the invention illustrated in FIGS. 5 and 6, means are provided for allowing an adjustment of the shock absorbing device stiffness without having to change the leaf springs 7*a* and 7*b.* The acute angles B1, B2 of the leaf springs longitudinal axis YY' with respect to the lower portion 4*a* of the sole can be changed, thus modifying the spring force component which resiliently resists forces tending to bring together the lower and upper portions of the sole. In FIG. 5, the angle B1 and corresponding effective shoe stiffness are greater than the angle B2 and corresponding stiffness shown in FIG. 6. In this illustrated example, the angle B can be changed by modifying the effective length of the front strand 920 fixed to the upper portion 4*b* at 922, by selecting the appropriate notch on rack 2. It will be understood that this system can also be used for the rear strand 921. In this construction, each spring is held at its upper end 71 by a link 92 or cable comprising a front strand 920 and a rear strand 921. The angle B can be changed by modifying the lengths of front 920 and rear 921 strands. The lower end 70 of each spring 7*a,* 7*b,* is held with appropriate means which allow each spring to pivot in its own plane, and also to pivot outwards to allow the springs to bend after buckling. Examples of possible lower connections are illustrated in FIGS. 7, 8*a,* and 8*b.*

Figure 7:
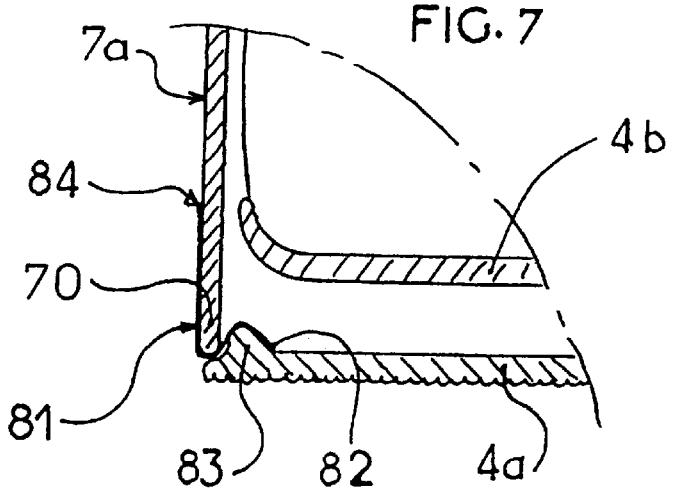
FIG. 7 is a rear view of a flexible lower retaining link used in the embodiment illustrated in FIGS. 5 and 6.

In FIG. 7, a flexible retaining link 81 is fixed at one end 82 to the lower portion 4*a* of the sole, winding over flange 83 on lower sole 4*a,* under the lower end 70 of the spring, and finally fixed to the spring at its other end 84.

Figure 8A:
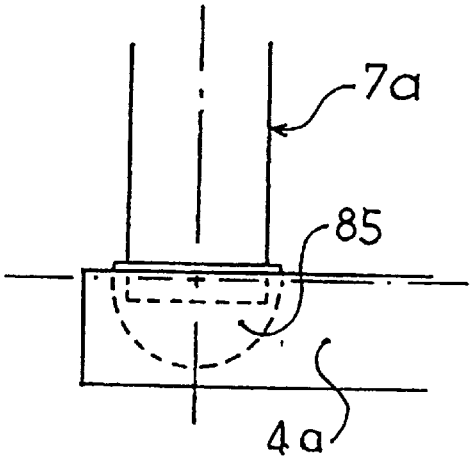
FIGS. 8*a* and 8*b* are side and rear views respectively of an alternative lower link.
Figure 8B:
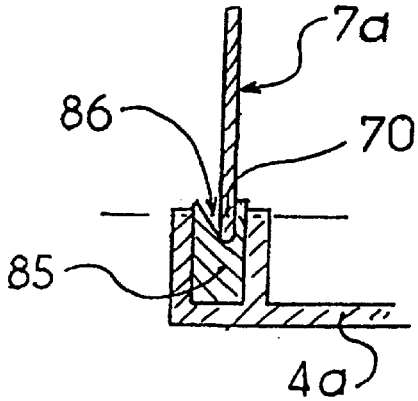

In FIGS. 8*a* and 8*b,* the leaf spring is connected to the lower sole 4*a* via a universal joint mechanism, composed of an intermediate wheel 85 which pivots on lower sole 4*a,* and comprises a V-groove 86 which houses leaf spring lower end 70.

Figure 9:
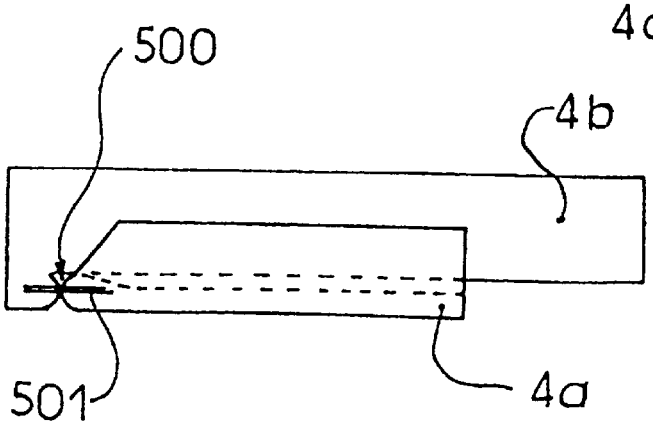
FIG. 9 is a side view of an alternative embodiment of a hinge mechanism for the shoe.

The rotation of the lower sole 4*a* with respect to upper sole 4*b* can be achieved by different means, for example using an axis 5 as illustrated in FIG. 1, or with a flexible zone 500 as illustrated in FIGS. 5 and 6, or as shown in FIG. 9 where the lower sole 4*a* and upper sole 4*b* are connected via a flexible link 501.

Figure 10:
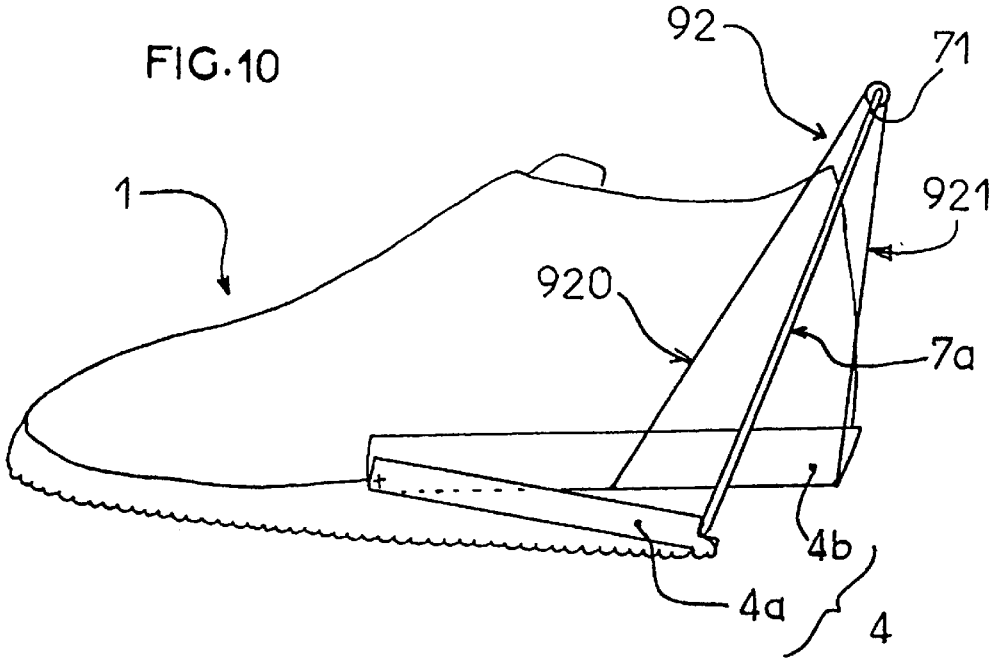
FIG. 10 is a side view of an alternative embodiment incorporating a spring force component adjusting device.
Figure 11A:
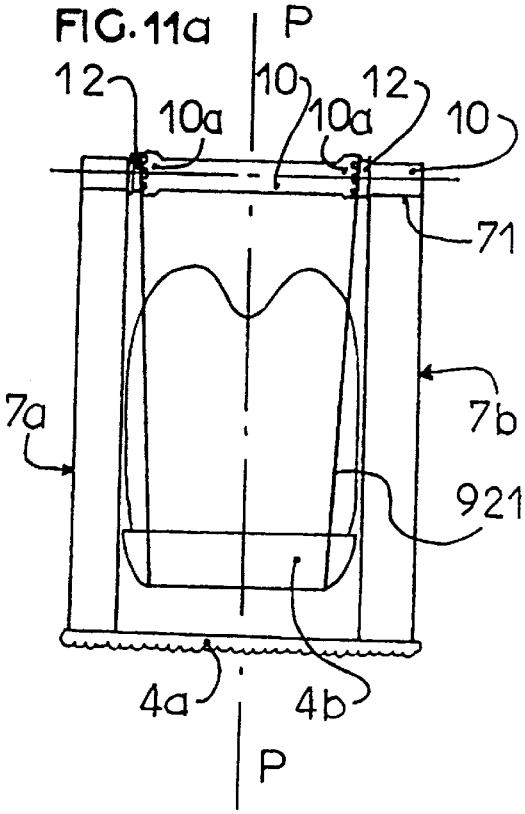
FIG. 11*a* is a rear view of the embodiment illustrated in FIG. 10.
Figure 11B:
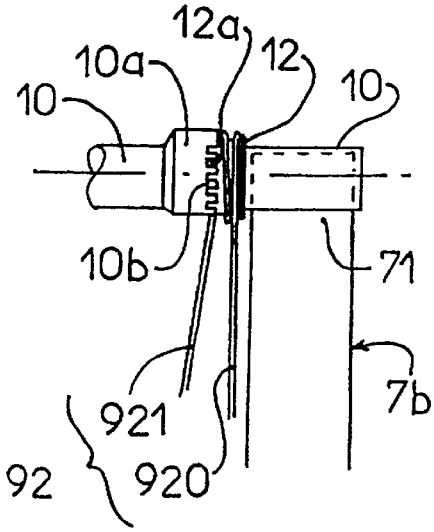
FIG. 11*b* is a rear view of a detail of the spring force adjusting device.

FIGS. 10 and 11 illustrate another embodiment of the invention where the plane of the springs 7*a*, 7*b*, is not parallel to the plane of symetry P of the shoe, as in the previous embodiments, but is approximately perpendicular to this plane. In this construction, the two leaf springs 7*a*, 7*b*, are tilted backwards, a transverse link 10 links the upper ends 71 of said springs. This transverse link 10 extends horizontally behind the user's Achilles' heel, and, as in the construction shown in FIGS. 5 and 6, the said upper spring ends 71 are connected to the upper portion 4*b* of the sole via a front strand 920 and a rear strand 921 of link 92. FIG. 11*b* is a detailed vue of a design which allows the user to change the setting of the angle of the leaf springs of the construction of FIGS. 10 and 11*a*. In this design, a cable 92 is fixed to and wrapped around a pulley 12 engaged with transverse link 10 at flange 10*a* via a gear system comprising corresponding teeth on pulley 12*a* and link flange 10*a*. To change the spring angle, the link flange 10*a* is disengaged from pulley teeth 12*a*, and the pulley is rotated to the desired setting, changing the effective lengths of the front 920 and rear 921 strands. This device is symetrical with respect to plane P.

FIG. 12 illustrates an alternative embodiment of the invention where the lower sole 4*a* is composed of two mobile lower portions 4'*a* and 4"*a*, which can pivot with respect to the upper portion 4*b* about two longitudinal axes 400*a* and 400*b*.

FIGS. 13*a*, 13*b*, and 13*c* illustrate three ways of applying the load on the leaf springs. In FIG. 13*a*, the leaf spring is straight, and load F is applied directly on the neutral axis similar to the construction shown in FIGS. 1, 2, and 3. This gives rise to the square buckling curve of FIG. 14, which shows the force-deflection curves under different conditions. Note that if the alignment is perfect, one cannot predict which way the leaf spring will buckle. This problem can be solved by using leaf springs as illustrated in FIGS. 13*b* and 13*c*. In FIG. 13*b*, applied load F is offset with respect to the neutral axis, and this eccentricity "e" gives rise to an initial moment F×e, before reaching the critical or Euler load, so that a rounded curve such as curve b of FIG. 14 is obtained. In the alternative constructions of FIGS. 4, 5, and 6, the eccentricity if greater than half the thickness of the spring. FIG. 13*c* illustrates another alternative where the said leaf spring is initially curved, giving an initial eccentricity "e" similar to that obtained with the alternative shown in FIG. 13*b*.

The leaf springs 7*a*, 7*b* must store large amounts of mechanical energy and withstand a high number of loading cycles with high forces and stresses, for a minimum weight and a reasonable cost. This can be done using composite materials, composed of layers of high mechanical strength fibers impregnated with a thermoplastic or a thermosetting resin matrix. The said springs can be made by piling several layers of woven fibers, for example bidirectional, so that the specific fiber orientation for each layer contributes to an optimal elastic leaf spring. Preferably the leaf springs would be manufactured in pultrusion, using unidirectional fibers in the longitudinal direction, with an epoxy resin.

Figure 15A:
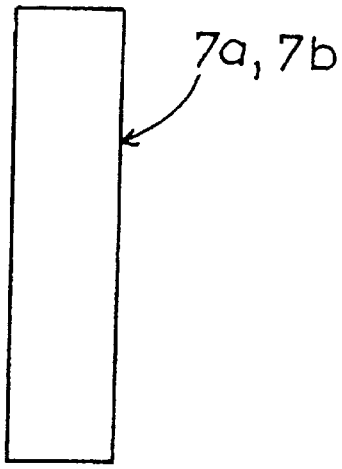
FIGS. 15*a* and 15*b* are side elevational views illustrating different leaf spring shapes.
Figure 15B:
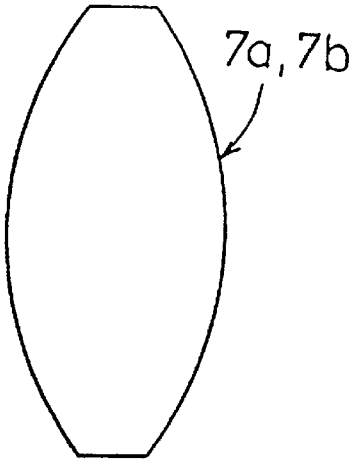

Advantageously, the width of the spring varies along the length so that the width is proportional to the moment at maximum load, i.e. wider in the middle than at the ends as illustrated in FIG. 15*b*. In this case, the width/length ratio and the variation of width/length ratio are high, creating relatively high shearing stresses between the central portion and the two lateral portions. Cross fibers at 90° offer a higher shear stress resistance, either for example at the core of the spring, near the neutral axis, or by gluing or welding a layer of cross-fibers in a highly elastic strain matrix, on at least one of the two faces of the leaf spring.

Figure 16A:
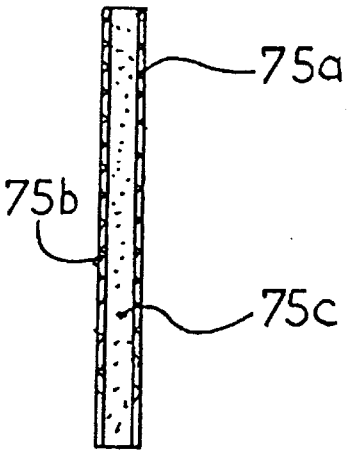
FIGS. 16*a* and 16*b* are two longitudinal sections of alternative embodiments of the leaf spring.
Figure 16B:
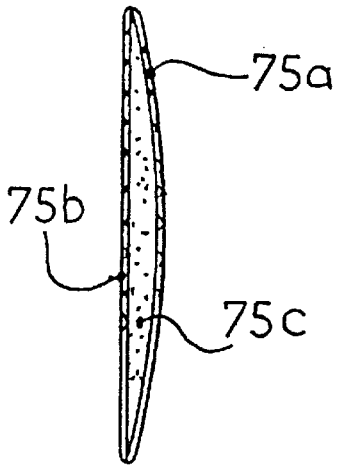

Given that the core of the leaf spring is subjected mainly to shearing stresses, and contributes little to the stiffness, strength, and energy stored, a sandwich-type construction can be used, with lighter plastic at the core, and unidirectional fibers on the faces. FIGS. 16*a* and 16*b* illustrate a sandwich-type leaf spring with a central core 75*c* covered with two composite external faces 75*a* and 75*b*. The central layer can be made of still or soft plastic, while the external layers 75*a* and 75*b* are made of composite materials as described above, the density of the ends 70 and 71 of the core 75*c* of the leaf spring being at least equal to the density of the core in the middle. A plastic sheet can also be glued or welded on each face to protect the spring from humidity, ultraviolet rays, and scratches.

Figure 15C:
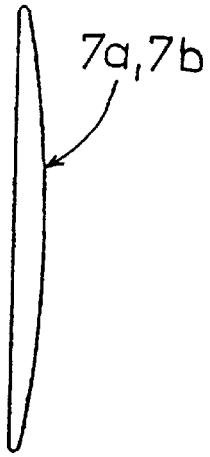
FIG. 15*c* is a longitudinal section of an alternative embodiment of the leaf spring.
Figure 15D:
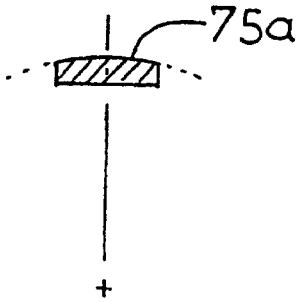
FIGS. 15*d* and 15*e* are two cross-sectional views of alternative sections of the leaf spring.
Figure 15E:
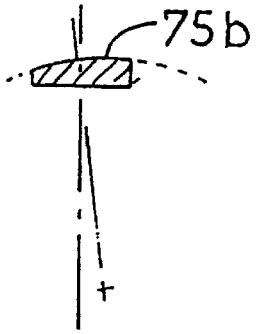

The leaf springs 7*a* and 7*b* must be relatively long and thin so as to bucket at the desired load. Their composition and dimensions must be chosen according to the required performance. The width can be either constant, as illustrated in FIGS. 5, 6, 11*a* and 15*a*, or variable, as illustrated in FIGS. 1 and 15*b*. FIGS. 15*d* and 15*e* illustrate an alternative leaf spring construction with a variable thickness, the compression face being plane, while the external face 75*a*, under tension when the spring flexes, has a curved cross-section, so that the lateral edges of the leaf spring are thinner than the central portion. Naturally, the leaf spring thickness can be constant or variable, as illustrated in FIGS. 15*c* and 16*b* (in the longitudinal direction) or in FIGS. 15*d* and 15*e* (in the transverse direction), while remaining within the scope of the invention.

Means can be provided for to allow the springs to be taken out, to be exchanged in case of breaking or to adapt the spring to the user's needs.

It is possible to make the dihedron hermetic, for example with a bellows-type of system, to avoid any intrusion of foreign particles such as stones. Also, the shoe according to the invention can be combined with other known devices such as foam, air pockets, linear or other springs, placed in the dihedron.

It is understood that the above-described embodiments are merely illustrative, and that the invention includes all technical equivalents as well as their combinations.

What is claimed is:

1. A show, composed of an upper fixed to a sole, said sole comprising at least generally in the heel area:

a lower portion mobile in the vertical direction only with respect to an upper portion, and at least one elastically bendable leaf spring which resiliently resists forces tending to bring together said lower and upper portions of the sole, each leaf spring being connected at its lower end to said lower portion of the sole by lower linking means, and at its upper end to said upper portion of the sole by upper linking means, each said leaf spring being free to pivot about its ends with respect to said linking means, and wherein each said leaf spring is outside the space under a wearer's foot and said shoe upper, and wherein the moment arm, which causes the leaf spring to bend, is initially small with respect to the leaf spring length when the shoe is not loaded, and increases significantly with increasing load, so that each leaf spring bends in a manner substantially similar to pin-ending buckling.

2. A shoe according to claim 1 wherein each said leaf spring is made of composite materials, composed of high mechanical strength unidirectional fibers in the longitudinal direction, at least near external faces, in a resin matrix.

3. A shoe according to claim 2 wherein the lower portion of the sole is brought closer to the upper portion of the sole by pivoting about a transverse axis.

4. A shoe according to claim 3 wherein the lower end of each said leaf spring is vertically aligned with an wearer's ankle.

5. A shoe according to claim 3 wherein each leaf spring is long, its upper end positioned above the heel level, and comprises a force component which resists forces tending to bring the lower and upper portions of the sole closer together.

6. A shoe according to claim 5 wherein each leaf spring is tilted at an angle about a transverse axis, and wherein said angle is adjustable.

7. A shoe according to claim 6 wherein said upper linking means comprise front and rear link strands, and wherein said spring angle is adjustable by changing the effective length of at least one of said front and rear link strands connecting the upper end of each said leaf spring to said upper portion of the sole.

8. A shoe according to any one of the preceding claims wherein the moment of inertia in a central part of each said leaf spring is at least equal to the moment of inertia at the upper and lower ends.

9. A shoe according to claim 8 wherein the core of each leaf spring is made of a composite material comprising fibers with a transverse component.

10. A shoe according to claim 8 wherein said lower linking means connecting each leaf spring's lower end to the lower portion of the sole consist of a flexible retaining link fixed at one end to the lower portion of the sole, winding over a flange on the lower portion of the sole, under the leaf spring lower end, and finally fixed to the leaf spring at the other end of said flexible retaining link.

11. A shoe according to claim 8 wherein said upper linking means connecting each leaf spring's upper end to the upper portion of the sole consist of at least one flexible retaining link fixed at its lower end to the upper portion of the sole, the upper end of the flexible retaining link winding partially over each leaf spring upper end, and finally fixed to said leaf spring.

12. A shoe according to claim 8 wherein said lower linking means connecting each leaf spring's lower end to the lower portion of the sole consist of a lower housing bound with the lower portion of the sole, into which the lower end of each said leaf spring is housed and pivots freely about its lower end.

13. A shoe according to claim 8 wherein said upper linking means connecting each leaf spring's upper end to the upper portion of the sole consist of an upper housing bound with the upper portion of the sole, into which the upper end of each said leaf spring is housed and pivots freely about its upper end.

14. A shoe according to claim 8 wherein each said leaf spring is made of composite materials, composed of high mechanical strength unidirectional fiberglass in the longitudinal direction in a resin matrix, at least near the external faces.

15. A shoe according to claim 8 wherein each said leaf spring is made of composite materials, composed of high mechanical strength unidirectional polyester fibers in the longitudinal direction in a resin matrix, at least near the external faces.

16. A shoe according to claim 8 wherein the core of each leaf spring is made of a soft material.

* * * * *

UNITED STATES PATENT AND TRADEMARK OFFICE

CERTIFICATE OF CORRECTION

PATENT NO. : 6,115,942

DATED : September 12, 2000

INVENTOR(S) : Frederic Paradis

It is certified that error appears in the above-identified patent and that said Letters Patent is hereby corrected as shown below:

| | |
|---|---|
| Column 3, line 67 reads | "...housing 9a and 9b ..." |
| it should read | "...housings 9a and 9b ..." |
| Column 4, line 18 reads | "...based ion....." |
| it should read | "...based on....." |
| Column 4, line 23 reads | "...flexible line 92 ...." |
| it should read | "...flexible link 92 ...." |
| Column 5, line 45 reads | "...eccentricity if greater than..." |
| it should read | "...eccentricity is greater than..." |
| Column 6, line 14 reads | "...made of still or soft plastic..." |
| it should read | "...made of stiff or soft plastic..." |

UNITED STATES PATENT AND TRADEMARK OFFICE

CERTIFICATE OF CORRECTION

PATENT NO. : 6,115,942

DATED : September 12, 2000

INVENTOR(S) : Frederic Paradis

It is certified that error appears in the above-identified patent and that said Letters Patent is hereby corrected as shown below:

| | |
|---|---|
| Column 6, line 22 reads | "...so as to bucket at the desired load..." |
| it should read | "...so as to buckle at the desired load..." |
| Column 6, line 49 reads | "A show, composed of..." |
| it should read | "A shoe, composed of..." |

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*